US010868408B2

(12) United States Patent
Gozawa et al.

(10) Patent No.: US 10,868,408 B2
(45) Date of Patent: Dec. 15, 2020

(54) SPARK PLUG

(71) Applicant: NGK SPARK PLUG CO., LTD., Nagoya (JP)

(72) Inventors: Tatsuya Gozawa, Nagoya (JP); Kenji Ban, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/801,497

(22) Filed: Feb. 26, 2020

(65) Prior Publication Data

US 2020/0287358 A1 Sep. 10, 2020

(30) Foreign Application Priority Data

Mar. 5, 2019 (JP) ..... 2019-039408

(51) Int. Cl.
*H01T 13/16* (2006.01)

(52) U.S. Cl.
CPC ..... *H01T 13/16* (2013.01)

(58) Field of Classification Search
CPC ..... H01T 13/16
See application file for complete search history.

(56) References Cited

U.S. PATENT DOCUMENTS 2,081,501 A * 5/1937 Nowosielski ..... H01T 13/16
2011/0148274 A1* 6/2011 Ernst ..... H01T 13/467 313/141
2016/0141840 A1* 5/2016 Matsunaga ..... H01T 13/467 313/139
2016/0156158 A1* 6/2016 Thomas ..... H01T 13/32 313/11.5
2018/0123324 A1* 5/2018 Niessner ..... H01T 13/54
2020/0036166 A1* 1/2020 Kuhnert ..... H01T 21/02
2020/0165960 A1* 5/2020 Takada ..... H01T 13/54

FOREIGN PATENT DOCUMENTS

DE 3107971 A1 * 9/1982 ..... H01T 13/16
DE 102014117714 A1 * 6/2016 ..... H01T 13/32
JP 2012-199236 A 10/2012
WO WO-2019126838 A1 * 7/2019 ..... H01T 13/54

* cited by examiner

*Primary Examiner* — Donald L Raleigh
(74) *Attorney, Agent, or Firm* — Kusner & Jaffe

(57) ABSTRACT

A spark plug that can suppress pre-ignition of a combustible air-fuel mixture that has flowed into the sub-chamber. The spark plug includes a ground electrode that joins to a metal shell and forms a spark gap; and a cap member that covers a center electrode and the ground electrode and forms a sub-chamber. A first fused portion that joins the metal shell and the cap member is located on the front-end side relative to the spark gap. At least a part of a first facing portion at which the metal shell and the cap member face each other is located on the sub-chamber side relative to the first fused portion. The first fused portion is not formed in an inner peripheral surface of the metal shell and an inner peripheral surface of the cap member.

9 Claims, 5 Drawing Sheets

SPARK PLUG

FIELD OF THE INVENTION

The present invention relates to a spark plug in which a cap member that forms a sub-chamber is joined to a metal shell.

BACKGROUND OF THE INVENTION

A spark plug in which a cap member that forms a sub-chamber is joined via a fused portion to a metal shell that is to be attached to an engine is known (see, for example, Japanese Unexamined Patent Application Publication No. 2012-199236, hereinafter "PTL 1"). A spark plug of this type generates a flame in the sub-chamber by igniting a combustible air-fuel mixture that has flowed into the sub-chamber from through holes in the cap member, ejects gas flow including the flame into a combustion chamber from the through holes, and causes a combustible air-fuel mixture in the combustion chamber to quickly burn by using the ejected gas flow.

However, the technology described in PTL 1 has the following problem: because the fused portion, which has lower thermal conductivity than the cap member and the metal shell, is exposed in the sub-chamber, the fused portion becomes overheated and causes pre-ignition of the combustible air-fuel mixture that has flowed into the sub-chamber.

SUMMARY OF THE INVENTION

The present invention has been made in order to solve the problem, and an object thereof is to provide a spark plug that can suppress pre-ignition of a combustible air-fuel mixture that has flowed into the sub-chamber.

In order to achieve the object, a spark plug according to the present invention includes: a tubular metal shell that extends from a front-end side toward a rear-end side along an axial line; a center electrode that is insulated and held on an inner peripheral side of the metal shell; a ground electrode that has one end portion joined to the metal shell and the other end portion forming a spark gap between the other end portion and a front end portion of the center electrode; and a cap member that is joined to a front end portion of the metal shell, that covers the front end portion of the center electrode and the other end portion of the ground electrode and forms a sub-chamber, and in which a through hole that connects the sub-chamber and a combustion chamber is formed. A first fused portion that joins the metal shell and the cap member is located on the front-end side relative to the spark gap. The spark plug includes a first facing portion at which the metal shell and the cap member face each other. At least a part of the first facing portion is located on the sub-chamber side relative to the first fused portion. The first fused portion is not formed in an inner peripheral surface of the metal shell and an inner peripheral surface of the cap member.

A spark plug according to the present invention includes: a tubular metal shell that extends from a front-end side toward a rear-end side along an axial line; a center electrode that is insulated and held on an inner peripheral side of the metal shell; a ground electrode that has one end portion joined to the metal shell and the other end portion forming a spark gap between the other end portion and a front end portion of the center electrode; and a cap member that is joined to a front end portion of the metal shell, that covers the front end portion of the center electrode and the other end portion of the ground electrode and forms a sub-chamber, and in which a through hole that connects the sub-chamber and a combustion chamber is formed. The ground electrode is joined to the metal shell via a second fused portion. The spark plug includes a second facing portion at which the metal shell and the ground electrode face each other. At least a part of the second facing portion is located on the sub-chamber side relative to the second fused portion. The second fused portion is not formed in an inner peripheral surface of the metal shell and a region of the ground electrode disposed in the sub-chamber.

With the spark plug according to a first aspect, the first fused portion, which joins the metal shell and the cap member, is located on the front-end side relative to the spark gap. At least a part of first facing portion at which the metal shell and the cap member face each other is located on the sub-chamber side relative to the first fused portion. Because the first fused portion is not formed in the inner peripheral surface of the metal shell and the inner peripheral surface of the cap member, it is possible to suppress overheating of the first fused portion. Thus, it is possible to suppress pre-ignition of the combustible air-fuel mixture, which has flowed into the sub-chamber, due to overheating of the first fused portion.

With a spark plug according to a second aspect, due to the first facing portion that is bent, it is possible to provide a sufficient distance from the sub-chamber to the first fused portion. Because it is possible to reduce the effect of heat of the first fused portion on sub-chamber, in addition to the advantage of the first aspect, it is possible to further suppress pre-ignition of the combustible air-fuel mixture that has flowed into in the sub-chamber.

With a spark plug according to a third aspect, the inner peripheral surface of the cap member conforms to the inner peripheral surface of the metal shell, and an end of the first facing portion inside in a radial direction is located on the rear-end side in an axial direction relative to an end of the first facing portion outside in the radial direction. Thus, it is easy to dispose a step, which is formed between the metal shell and the cap member due to the first facing portion, on the rear-end side of the sub-chamber. The velocity of gas flow ejected from the through hole into the combustion chamber is lower on the rear-end side of the sub-chamber than on the front-end side of the sub-chamber. Therefore, by providing the step on the rear-end side of the sub-chamber, in addition to the advantage of the second aspect, it is possible to reduce the effect of turbulent flow, which occurs due to the step, on the ejected flow.

With a spark plug according to a fourth aspect, in the first facing portion, a first part is located on an innermost side in the radial direction; and, at a second part that is connected to an outside of the first part in the radial direction, the metal shell and the cap member face each other in a direction different from a direction in which the metal shell and the cap member face each other at the first part. Because the cap member is in contact with the metal shell along an entire periphery at the second part, in addition to the advantage of the second or third aspect, it is possible to further reduce the effect of the first fused portion on pre-ignition.

With a spark plug according to a fifth aspect, because the first fused portion is in contact with the second part, in addition to the advantage of any one of the second to fourth aspects, it is possible to increase the joint strength compared with a case where the first fused portion is not in contact with the second part.

With a spark plug according to a sixth aspect, in a cross section including the axial line, a shortest distance of the first fused portion from an outer peripheral surface of the first fused portion, the outer peripheral surface being exposed at an outer peripheral surface of the cap member, to the first facing portion is larger than or equal to a shortest distance of the first facing portion along the first facing portion. Thus, in addition to the advantage of any one of the first to fifth aspects, it is possible to increase the joint strength.

With a spark plug according to a seventh aspect, the ground electrode is joined to the metal shell via the second fused portion, and at least a part of the second facing portion at which the metal shell and the ground electrode face each other is located on the sub-chamber side relative to the second fused portion. Because the second fused portion is not formed in the inner peripheral surface of the metal shell and a region of the ground electrode disposed in the sub-chamber, it is possible to suppress overheating of the second fused portion. Thus, it is possible to suppress pre-ignition of the combustible air-fuel mixture, which has flowed into the sub-chamber, due to overheating of the second fused portion.

With a spark plug according to an eighth aspect, because the second facing portion is bent, it is possible to provide a sufficient distance from the sub-chamber to the second fused portion due to the second facing portion. Thus, in addition to the advantage of the seventh aspect, it is possible to further suppress pre-ignition of the combustible air-fuel mixture that has flowed into the sub-chamber.

With a spark plug according to a ninth aspect, in the second facing portion, a third part is located on an innermost side in a radial direction; and, at a fourth part that is connected to an outside of the third part in the radial direction, the metal shell and the ground electrode face each other in a direction different from a direction in which the metal shell and the ground electrode face each other at the third part. Because the second fused portion is in contact with the fourth part, in addition to the advantage of the eighth aspect, it is possible to increase the joint strength compared with a case where second fused portion is not in contact with the fourth part.

DETAILED DESCRIPTION OF THE INVENTION

Figure 1:
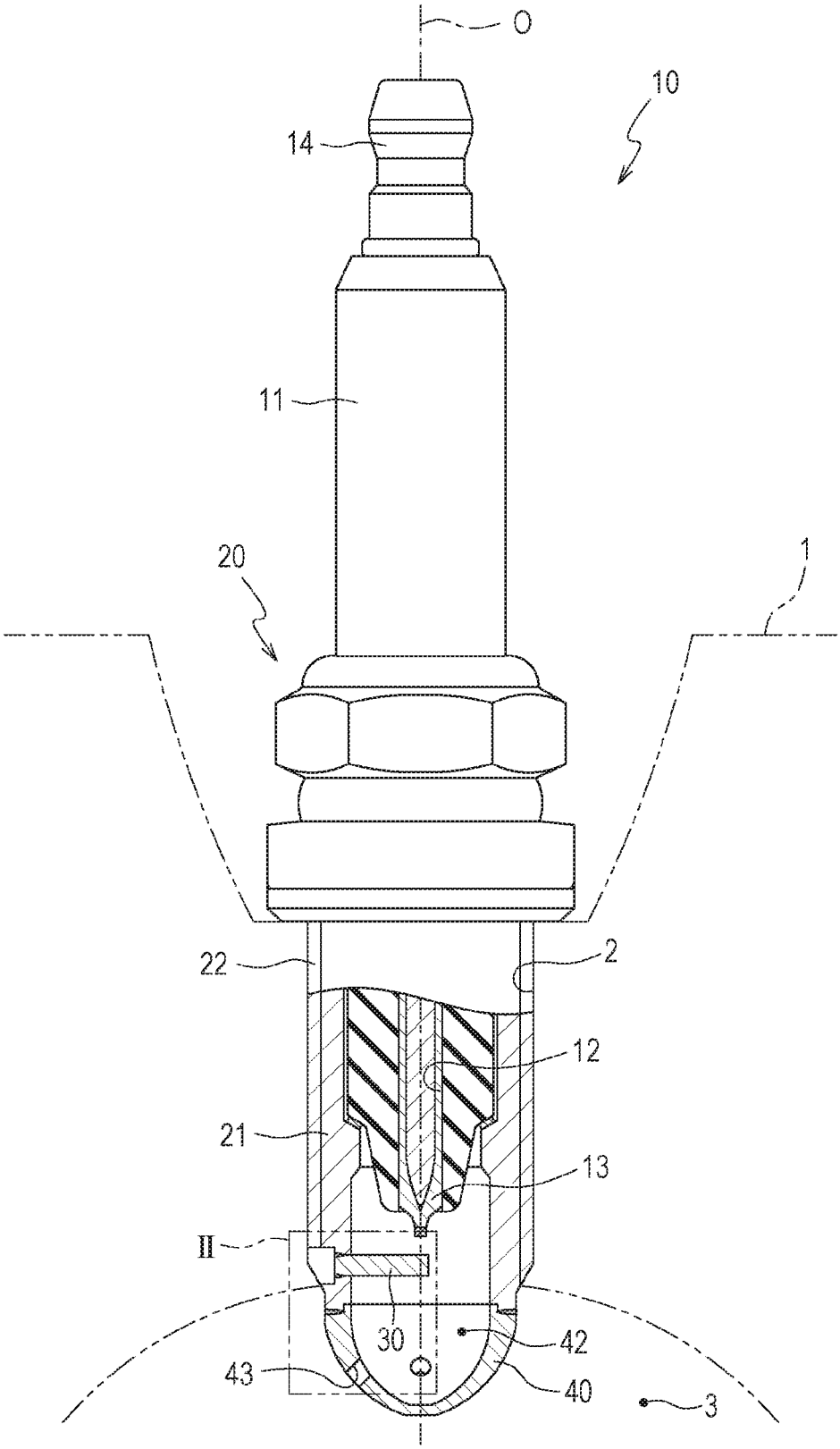
FIG. 1 is a partially cross-sectional view of a spark plug according to a first embodiment.

Hereafter, embodiments of the present invention will be described with reference to the drawings. FIG. 1 is a partially cross-sectional view a spark plug 10 according to a first embodiment. The lower side in FIG. 1 will be referred to as the "front-end side" of the spark plug 10, and the upper side in FIG. 1 will be referred to as the "rear-end side" of the spark plug 10 (the same applies to FIGS. 2 to 5). FIG. 1 illustrates a cross section, including an axial line O, of a portion of the spark plug 10 on the front-end side. As illustrated in FIG. 1, the spark plug 10 includes an insulator 11, a center electrode 13, a metal shell 20, a ground electrode 30, and a cap member 40.

The insulator 11 is a substantially cylindrical member in which an axial hole 12 extending along the axial line O is formed. The insulator 11 is made of ceramics, such as alumina, having desirable mechanical characteristics and high insulation ability in high temperatures. The center electrode 13 is disposed on the front-end side of the axial hole 12 of the insulator 11. The center electrode 13 is electrically connected to a metal terminal 14 in the axial hole 12. The metal terminal 14 is a bar-shaped member to which a high-voltage cable (not shown) is to be connected. The metal terminal 14 is made of an electroconductive metal material (such as low-carbon steel). The metal terminal 14 is fixed to the rear end of the insulator 11.

The metal shell 20 is a substantially cylindrical member made of an electroconductive metal material (such as low-carbon steel). The metal shell 20 surrounds the front-end side of the insulator 11 and holds the insulator 11 therein. An external thread 22 is formed on an outer peripheral surface of a trunk portion 21 on the front-end side of the metal shell 20. The external thread 22 is a portion to be screwed into a threaded hole 2 of an engine 1. The ground electrode 30 is joined to the trunk portion 21 of the metal shell 20.

The ground electrode 30 is a bar-shaped member mainly made of Ni and the like. In the present embodiment, the ground electrode 30 is disposed at the position of the external thread 22, extends through the trunk portion 21, and faces the center electrode 13. The cap member 40 is joined to a front end portion of the metal shell 20. The cap member 40 is a member mainly made of Ni and the like, and forms a sub-chamber 42. In the present embodiment, the cap member 40 is hemispherical. In a state in which the spark plug 10 is attached to the threaded hole 2 of the engine 1 via the external thread 22, the cap member 40 is exposed in a combustion chamber 3 of the engine 1. A plurality of through holes 43, which connect the combustion chamber 3 and the sub-chamber 42, are formed in the cap member 40.

Figure 2:
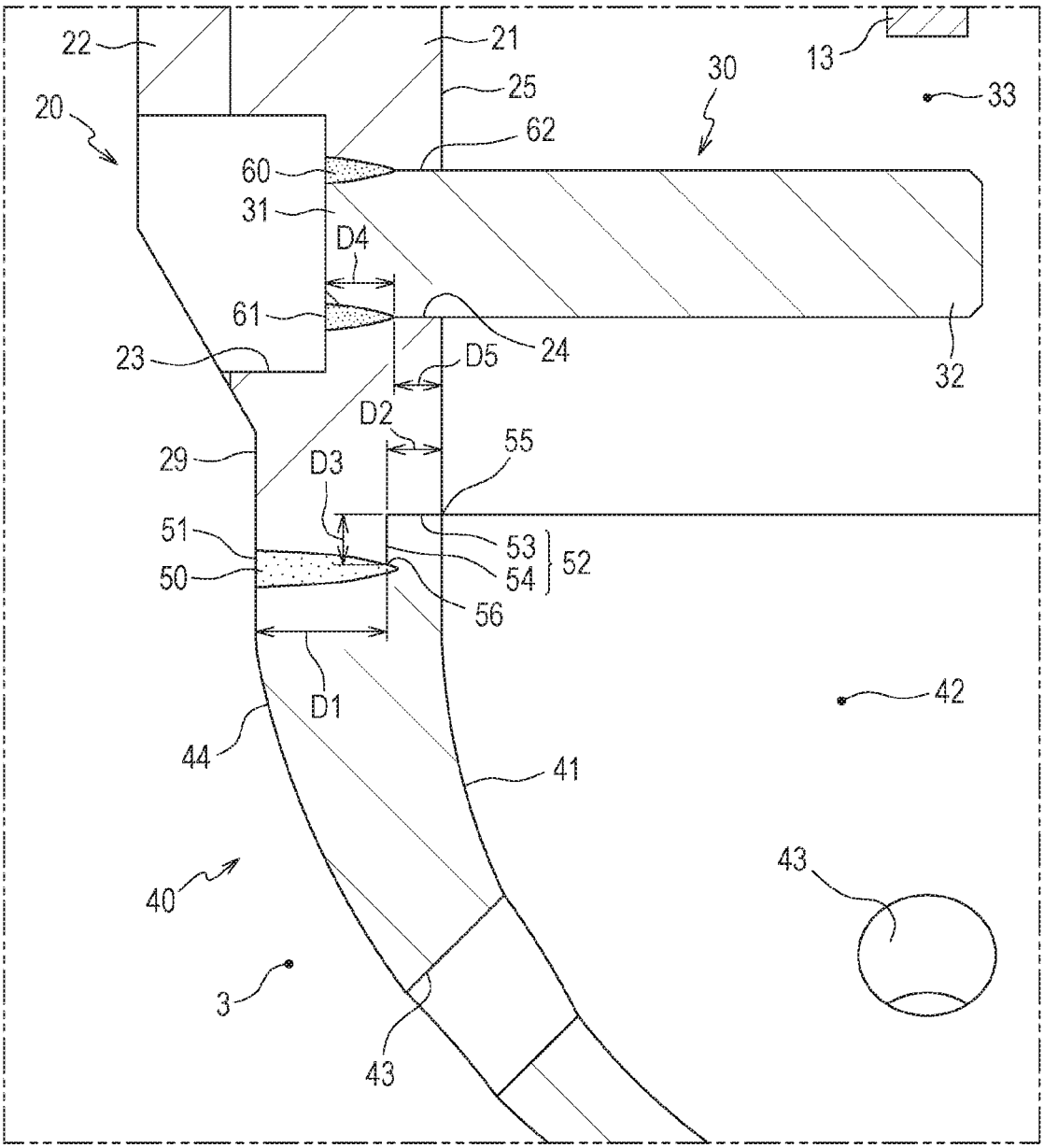
FIG. 2 is a cross-sectional view of the spark plug, illustrating a magnified view of a portion II in FIG. 1.

FIG. 2 is a cross-sectional view of the spark plug 10, illustrating a magnified view of a portion II in FIG. 1 and including the axial line O. A recessed portion 23, which is recessed inward in the radial direction, is formed in a part of the trunk portion 21 of the metal shell 20 having the external thread 22. A hole 24, which is thinner than the recessed portion 23, is formed in the trunk portion 21 at a position inside of the recessed portion 23 in the radial direction. The hole 24 extends through the trunk portion 21 and forms an opening in each of an inner peripheral surface 25 of the metal shell 20 and the recessed portion 23.

One end portion 31 of the ground electrode 30 is inserted into the hole 24, and the other end portion 32 of the ground electrode 30 forms a spark gap 33 between the other end portion 32 and a front end portion of the center electrode 13. Because the one end portion 31 of the ground electrode 30 is joined via a second fused portion 60 to a part of the metal shell 20 having the external thread 22, heat of the ground electrode 30 is transferred to the engine 1 from the external thread 22 via the threaded hole 2. The other end portion 32 of the ground electrode 30 is provided on the axial line O on the front end side of the center electrode 13. The ground electrode 30 is press-fitted into the hole 24, and the ground electrode 30 is in contact with the entire periphery of the hole 24.

The cap member 40 covers the front end portion of the center electrode 13 and the other end portion 32 of the ground electrode 30 and forms the sub-chamber 42. In order to prevent a step from being easily formed at the boundary between a spherical-cap-shaped inner peripheral surface 41 of the cap member 40 and the cylindrical inner peripheral surface 25 of the metal shell 20, the cap member 40 is disposed in such a way that the inner peripheral surface 41 of the cap member 40 conforms to the inner peripheral surface 25 of the metal shell 20. The through holes 43 of the cap member 40, which connect the sub-chamber 42 and the combustion chamber 3, are inclined downward toward an outer peripheral surface 44 of the cap member 40.

A first fused portion 50, which joins the metal shell 20 and the cap member 40, is located on the front-end side relative to the spark gap 33, and is formed along the entire peripheries of the metal shell 20 and the cap member 40 around the axial line O. The first fused portion 50 is a portion at which the base materials of the metal shell 20 and the cap member 40 are fused together. The thermal conductivity of the first fused portion 50 is lower than the thermal conductivity of the base material of the metal shell 20 and the thermal conductivity of the base material of the cap member 40.

A first facing portion 52, at which the metal shell 20 and the cap member 40 face each other, includes a first part 53 that is located on the innermost side of the cap member 40 in the radial direction and a second part 54 that is connected to the outside of the first part 53 in the radial direction. The first part 53 is an annular portion, and the second part 54 is a cylindrical portion. The second part 54 is bent with respect to the first part 53 toward the front-end side in the axial direction. The second part 54 is a so-called interference fit. At the second part 54, the cap member 40 is in contact with the metal shell 20 along the entire periphery.

The first fused portion 50 is in contact with the second part 54. A part of the first part 53 of the first facing portion 52 (a part of the first part 53 inside in the radial direction) is located on the sub-chamber 42 side relative to the first fused portion 50. The first fused portion 50 is not formed in the inner peripheral surface 25 of the metal shell 20 and the inner peripheral surface 41 of the cap member 40.

The cap member 40 is joined to the metal shell 20 via the first fused portion 50 so that the inner peripheral surface 41 of the cap member 40 conforms to the inner peripheral surface 25 of the metal shell 20. An end 55 of the first facing portion 52 inside in the radial direction is located on the rear-end side in the axial direction relative to an end 56 of the first facing portion 52 outside in the radial direction. The end 55 of the first facing portion 52 is located on the rear-end side relative to the through holes 43.

A distance D1 (shortest distance) is the length of a line segment that is the shortest among line segments that connect an outer peripheral surface 51 of the first fused portion 50, which is exposed at the outer peripheral surface 44 of the cap member 40 and an outer peripheral surface 29 of the metal shell 20, and the intersection of the first fused portion 50 and the first facing portion 52 (the end 56). A distance of the first facing portion 52 (creepage distance) that is the sum of a distance D2 and a distance D3 is the shortest distance from the end 55 to the end 56 of the first facing portion 52 along the first facing portion 52. In the spark plug 10, the distance D1 is larger than or equal to the sum of the distance D2 and the distance D3.

The ground electrode 30 will be described. The second fused portion 60, which joins the metal shell 20 and the ground electrode 30, is formed along the entire periphery of the one end portion 31 of the ground electrode 30. The second fused portion 60 is a portion at which the base materials of the metal shell 20 and the ground electrode 30 are fused together. The thermal conductivity of the second fused portion 60 is lower than the thermal conductivity of the base material of the metal shell 20 and the thermal conductivity of the base material of the ground electrode 30.

The entirety of a second facing portion 62, at which the metal shell 20 and the ground electrode 30 face each other, is located on the sub-chamber 42 side relative to the second fused portion 60. The second fused portion 60 is not formed in the inner peripheral surface 25 of the metal shell 20 and in a portion of the ground electrode 30 disposed in the sub-chamber 42.

A distance D4 (shortest distance) is the length of a line segment that is the shortest among line segments that connect an outer peripheral surface 61 of the second fused portion 60, which is exposed in the recessed portion 23 of the metal shell 20, and the intersection of the second fused portion 60 and the second facing portion 62. A distance D5 is the shortest distance from the second fused portion 60 to the inner peripheral surface 25 of the metal shell 20 along the second facing portion 62. In the spark plug 10, the distance D4 is larger than or equal to the distance D5.

The spark plug 10 generates a flame kernel in the spark gap 33 by causing a spark discharge between the center electrode 13 and the ground electrode 30, and ignites a combustible air-fuel mixture that has flowed into the sub-chamber 42 from the through holes 43 of the cap member 40. Gas flow generated in the sub-chamber 42 and including the flame is ejected from the through holes 43 of the cap member 40 into the combustion chamber 3, and the gas flow quickly burns a combustible air-fuel mixture in the combustion chamber 3.

With the spark plug 10, because the first fused portion 50, which has lower thermal conductivity than the metal shell 20 and the cap member 40, is not formed in the inner peripheral surface 25 of the metal shell 20 and the inner peripheral surface 41 of the cap member 40, it is possible to suppress overheating of the first fused portion 50. Thus, it is possible to suppress pre-ignition of the combustible air-fuel mixture, which has flowed into the sub-chamber 42, due to the first fused portion 50 functioning as an ignition source.

Because the first facing portion 52 is bent, it is possible to provide a sufficient distance from the inner peripheral surfaces 25 and 41 to the first fused portion 50 due to the first facing portion 52. Thus, it is possible to reduce the effect of heat of the first fused portion 50 on the inner peripheral surfaces 25 and 41, and therefore it is possible to further suppress pre-ignition of the combustible air-fuel mixture in the sub-chamber 42.

At the second part 54 of the first facing portion 52, the cap member 40 is in contact with the metal shell 20 along the entirety periphery so that a gap may not be formed between the cap member 40 and the metal shell 20. Therefore, it is possible to prevent radiation from the first fused portion 50 into the sub-chamber 42. Accordingly, it is possible to further suppress the effect of the first fused portion 50 on pre-ignition. Note that transmission of heat in the first part 53 is performed by heat conduction in a case where the metal shell 20 and the cap member 40 are in contact with each other and by radiation in a case where the metal shell 20 and the cap member 40 are separated.

The inner peripheral surface 41 of the cap member 40 conforms to the inner peripheral surface 25 of the metal shell 20, and the end 55 of the first facing portion 52 inside in the radial direction is located on the rear-end side relative to the end 56 of the first facing portion 52 outside in the radial direction. Therefore, it is easy to dispose a step, which is formed between the inner peripheral surfaces 25 and 41 of the metal shell 20 and the cap member 40 due to the first facing portion 52, on the rear-end side of the sub-chamber 42. The velocity of gas flow ejected from the through holes 43 into the combustion chamber 3 is lower on the rear-end side of the sub-chamber 42 than on the front-end side of the sub-chamber 42. Therefore, by disposing the step on the rear-end side of the sub-chamber 42, it is possible to reduce the effect of turbulent flow in the sub-chamber 42, which occurs due to the step, on the ejected gas flow in the combustion chamber 3.

The shortest distance D1 of the first fused portion 50 from the outer peripheral surface 51 of the first fused portion 50 to the first facing portion 52 is larger than or equal to the shortest distance (D2+D3) of the first facing portion 52 along the first facing portion 52. Thus, it is possible to increase the joint strength by penetration of the first fused portion 50. Moreover, because the first fused portion 50 is in contact with the second part 54, it is possible to increase the joint strength compared with a case where the first fused portion 50 is not in contact with the second part 54.

Because the second fused portion 60 is not formed in the inner peripheral surface 25 of the metal shell 20 and a region of the ground electrode 30 disposed in the sub-chamber 42, it is possible to suppress overheating of the second fused portion 60 having low thermal conductivity. Thus, it is possible to suppress pre-ignition of the combustible air-fuel mixture, which has flowed into the sub-chamber 42, due to the second fused portion 60 functioning as an ignition source. Moreover, the shortest distance D4 of the second fused portion 60 from the outer peripheral surface 61 of the second fused portion 60 to the second facing portion 62 is larger than or equal to the shortest distance D5 of the second facing portion 62 along the second facing portion 62. Thus, it is possible to increase the joint strength.

Figure 3:
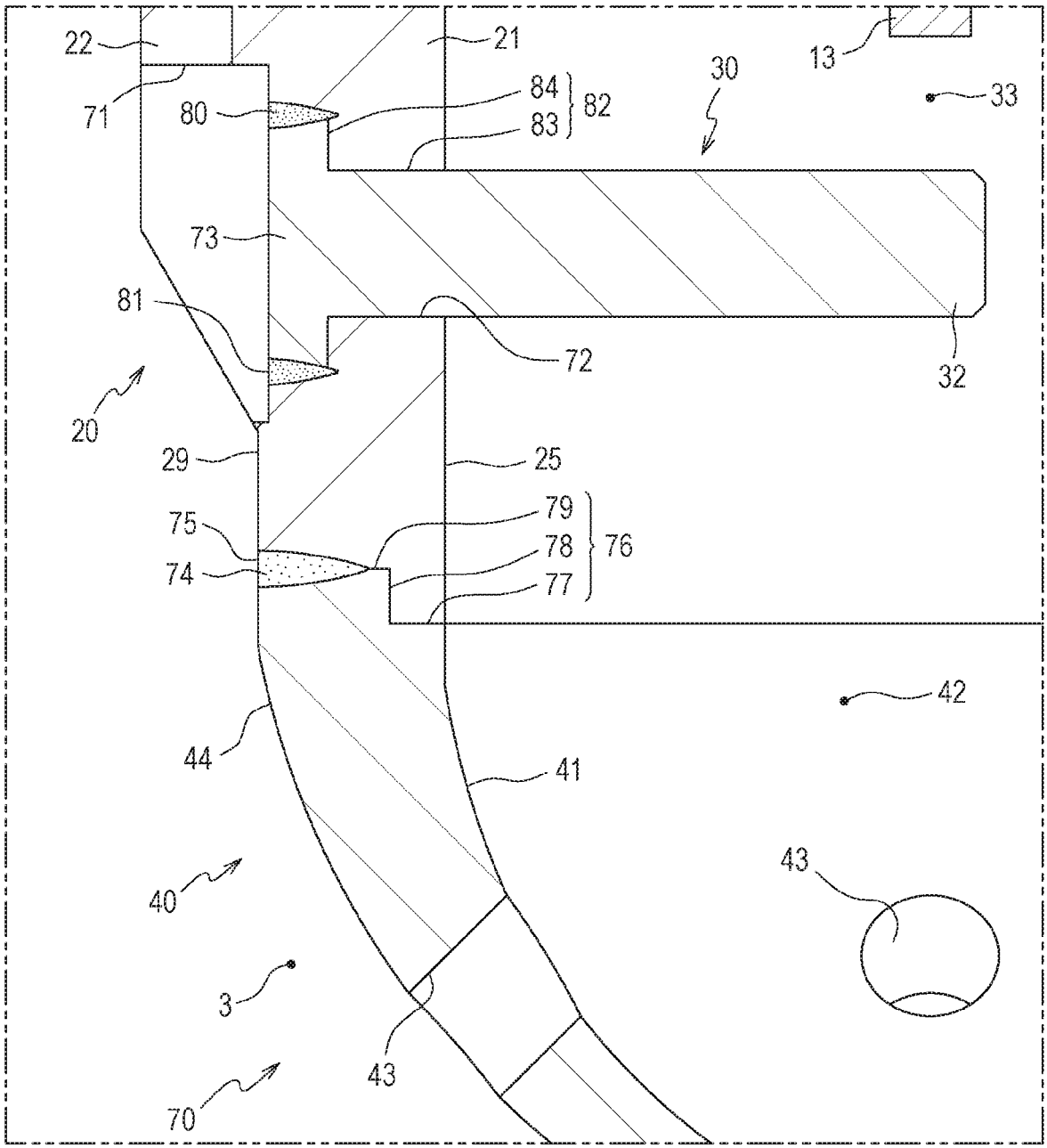
FIG. 3 is a cross-sectional view of a spark plug according to a second embodiment.

Referring to FIG. 3, a second embodiment will be described. The second embodiment is different from the first embodiment in the shape of a portion on the front-end side relative to the spark gap 33, but is the same as the first embodiment in other respects. Therefore, parts of the second embodiment that are the same as those described in the first embodiment will be denoted by the same numerals, and description of such parts will be omitted. FIG. 3 is a cross-sectional view of a spark plug 70 according to the second embodiment, including the axial line O. FIG. 3 is an enlarged view illustrating a portion II (see FIG. 1) of the spark plug 70 in the same way as in the first embodiment (the same applies to FIGS. 4 and 5).

A recessed portion 71, which is recessed inward in the radial direction, is formed in a part of the trunk portion 21 of the metal shell 20 having the external thread 22. A hole 72, which is thinner than the recessed portion 71, is formed in the trunk portion 21 at a position inside of the recessed portion 71 in the radial direction. The hole 72 extends through the trunk portion 21 and forms an opening in each of the inner peripheral surface 25 of the metal shell 20 and the recessed portion 71. The hole 72 is wide near the recessed portion 71 (on the outer peripheral surface 29 side of the metal shell 20) and is narrow near the inner peripheral surface 25. One end portion 73 of the ground electrode 30, which is inserted into the hole 72, has a flange-like shape that is thicker than the other end portion 32 of the ground electrode 30.

A first fused portion 74, which joins the metal shell 20 and the cap member 40, is located on the front-end side relative to the spark gap 33, and is formed along the entire peripheries of the metal shell 20 and the cap member 40 around the axial line O. The first fused portion 74 is a portion at which the base materials of the metal shell 20 and the cap member 40 are fused together. The thermal conductivity of the first fused portion 74 is lower than the thermal conductivity of the base material of the metal shell 20 and the thermal conductivity of the base material of the cap member 40.

A first facing portion 76, at which the metal shell 20 and the cap member 40 face each other, includes a first part 77 that is located on the innermost side of the cap member 40 in the radial direction, a second part 78 that is connected to the outside of the first part 77 in the radial direction, and an outer edge part 79 that is connected to the outside of the second part 78 in the radial direction. The first part 77 and the outer edge part 79 are each bent with respect to the second part 78 in a direction that intersects the axial line O. The second part 78 is a so-called interference fit. At the second part 78, the cap member 40 is in contact with the metal shell 20 along the entire periphery. The first part 77 is located on the front-end side relative to the outer edge part 79. The entirety of the first facing portion 76 is located on the sub-chamber 42 side relative to the first fused portion 74. The first fused portion 74 is not formed in the inner peripheral surface 25 of the metal shell 20 and the inner peripheral surface 41 of the cap member 40.

A second fused portion 80, which joins the metal shell 20 and the ground electrode 30, is formed along the entire periphery of the one end portion 73 of the ground electrode 30. The second fused portion 80 is a portion at which the base materials of the metal shell 20 and the ground electrode 30 are fused together. The thermal conductivity of the second fused portion 80 is lower than the thermal conductivity of the base material of the metal shell 20 and the thermal conductivity of the base material of the ground electrode 30.

A second facing portion 82, at which the metal shell 20 and the ground electrode 30 face each other, includes a third part 83 that is located on the innermost side of the metal shell 20 in the radial direction and a fourth part 84 that is connected to the outside of the third part 83 in the radial direction. The fourth part 84 is bent with respect to the third part 83. At the third part 83, the ground electrode 30 is a so-called interference fit, and the outer peripheral surface the ground electrode 30 is in contact with the metal shell 20 along the entire periphery.

The second fused portion 80 is in contact with the fourth part 84. A part of the third part 83 of the second facing portion 82 (a part of the third part 83 inside in the radial direction) is located on the sub-chamber 42 side relative to the second fused portion 80. The second fused portion 80 is not formed in the inner peripheral surface 25 of the metal shell 20 and a region of the ground electrode 30 disposed in the sub-chamber 42.

With the spark plug 70, because the first fused portion 74 is not formed in the inner peripheral surface 25 of the metal shell 20 and the inner peripheral surface 41 of the cap member 40, it is possible to suppress overheating of the first fused portion 74 and to suppress pre-ignition of a combustible air-fuel mixture that has flowed into the sub-chamber 42.

Because the first facing portion 76 is bent, it is possible to provide a sufficient distance from the inner peripheral surfaces 25 and 41 to the first fused portion 74, and to further suppress pre-ignition of the combustible air-fuel mixture in the sub-chamber 42 due to the first fused portion 74. Moreover, because the cap member 40 is in contact with the metal shell 20 along the entire periphery at the second part 78, it is possible to further reduce the effect of the first fused portion 74 on pre-ignition.

Because the second fused portion 80 is not formed in the inner peripheral surface 25 of the metal shell 20 and a region of the ground electrode 30 disposed in the sub-chamber 42, it is possible to suppress pre-ignition of the combustible air-fuel mixture, which has flowed into the sub-chamber 42, due to overheating of the second fused portion 80. Moreover, because the second facing portion 82 is bent, it is possible to provide a sufficient distance from the inner peripheral surface 25 of the metal shell 20 to the second fused portion 80, and to further suppress pre-ignition of the combustible air-fuel mixture in the sub-chamber 42.

Because the ground electrode 30 is in contact with the metal shell 20 along the entire periphery at the third part 83 of the second facing portion 82, it is possible to further reduce the effect of the second fused portion 80 on pre-ignition. Moreover, because the second fused portion 80 is in contact with the fourth part 84, it is possible to increase the joint strength of the second fused portion 80.

Figure 4:
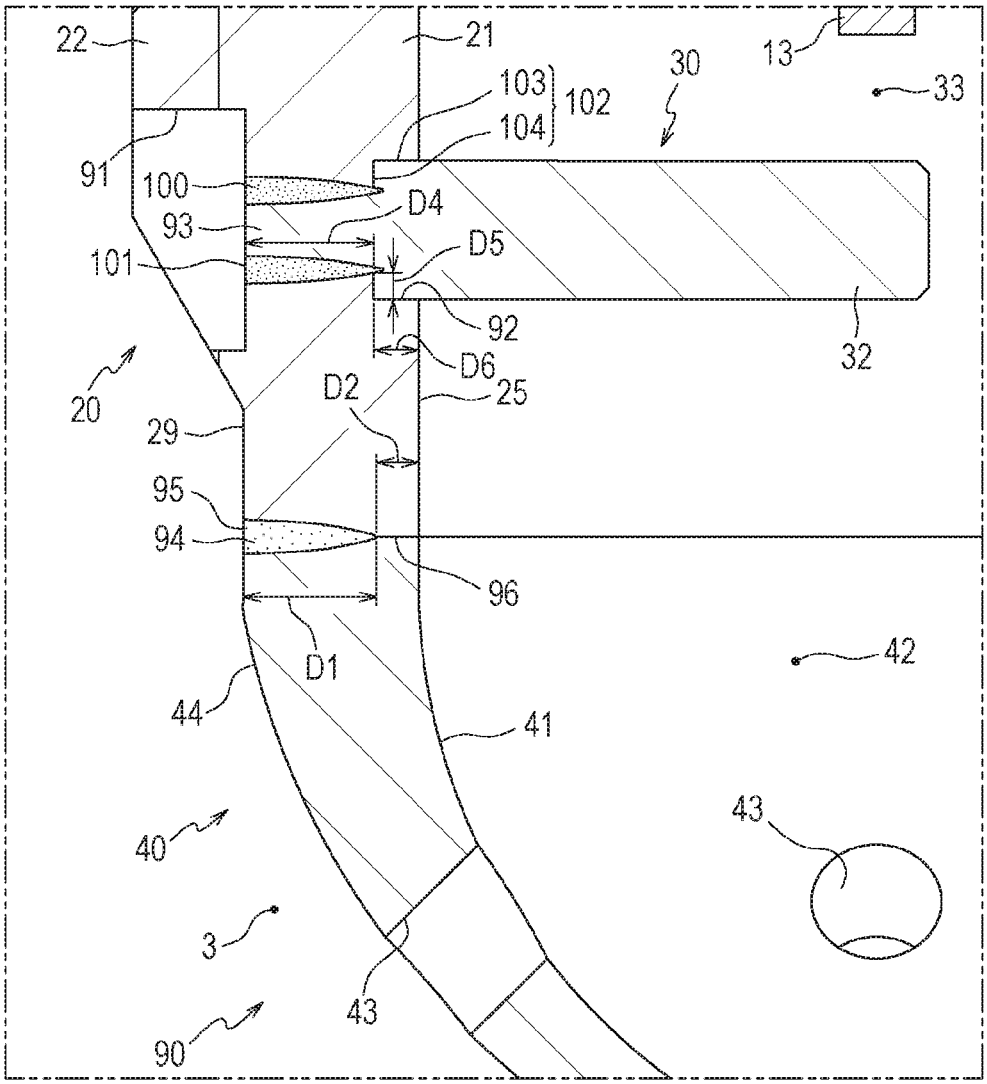
FIG. 4 is a cross-sectional view of a spark plug according to a third embodiment.

Referring to FIG. 4, a third embodiment will be described. The third embodiment is different from the first embodiment in the shape of a portion on the front-end side relative to the spark gap 33, but is the same as the first embodiment in other respects. Therefore, parts of the third embodiment that are the same as those described in the first embodiment will be denoted by the same numerals, and description of such parts will be omitted. FIG. 4 is a cross-sectional view of a spark plug 90 according to the third embodiment, including the axial line O.

A recessed portion 91, which is recessed inward in the radial direction, is formed in a part of the trunk portion 21 of the metal shell 20 having the external thread 22. A hole 92, which is thinner than the recessed portion 91, is formed in the trunk portion 21 at a position inside of the recessed portion 91 in the radial direction. The hole 92 extends through the trunk portion 21 and forms an opening in each of the inner peripheral surface 25 of the metal shell 20 and the recessed portion 91. The hole 92 is narrow near the recessed portion 91 (the outer peripheral surface 29 side of the metal shell 20) and is wide near the inner peripheral surface 25. One end portion 93 of the ground electrode 30, which is inserted into the hole 92, is thinner than the other end portion 32 of the ground electrode 30.

A first fused portion 94, which joins the metal shell 20 and the cap member 40, is located on the front-end side relative to the spark gap 33, and is formed along the entire peripheries of the metal shell 20 and the cap member 40 around the axial line O. The first fused portion 94 is a portion at which the base materials of the metal shell 20 and the cap member 40 are fused together. The thermal conductivity of the first fused portion 94 is lower than the thermal conductivity of the base material of the metal shell 20 and the thermal conductivity of the base material of the cap member 40.

The entirety of a first facing portion 96, at which the metal shell 20 and the ground electrode 30 face each other, is located on the sub-chamber 42 side relative to the first fused portion 94. At the first facing portion 96, the cap member 40 is in contact the metal shell 20. The first fused portion 94 is not formed in the inner peripheral surface 25 of the metal shell 20 and the inner peripheral surface 41 of the cap member 40.

A distance D1 (shortest distance) is the length of a line segment that is the shortest among line segments that connect an outer peripheral surface 95 of the first fused portion 94, which is exposed at the outer peripheral surface 44 of the cap member 40 and the outer peripheral surface 29 of the metal shell 20, and the intersection of the first fused portion 94 and the first facing portion 96. A distance D2 is the length of the first facing portion 96 along the first facing portion 96. In the spark plug 90, the distance D1 is larger than or equal to the distance D2.

A second fused portion 100, which joins the metal shell 20 and the ground electrode 30, is formed along the entire periphery of the one end portion 93 of the ground electrode 30. The second fused portion 100 is a portion at which the base materials of the metal shell 20 and the ground electrode 30 are fused together. The thermal conductivity of the second fused portion 100 is lower than the thermal conductivity of the base material of the metal shell 20 and the thermal conductivity of the base material of the ground electrode 30.

A second facing portion 102, at which the metal shell 20 and the ground electrode 30 face each other, includes a third part 103 that is located on the innermost side in the radial direction and a fourth part 104 that is connected to the outside of the third part 103 in the radial direction. The fourth part 104 is bent with respect to the third part 103. At the third part 103, the ground electrode 30 is a so-called interference fit, and the outer peripheral surface the ground electrode 30 is in contact with the metal shell 20 along the entire periphery.

The second fused portion 100 is in contact with the fourth part 104. A part of the third part 103 of the second facing portion 102 (a part of the third part 103 inside in the radial direction) is located on the sub-chamber 42 side relative to the second fused portion 100. The second fused portion 100 is not formed in the inner peripheral surface 25 of the metal shell 20 and a region of the ground electrode 30 disposed in the sub-chamber 42.

A distance D4 (shortest distance) is the length of a line segment that is the shortest among line segments that connect an outer peripheral surface 101 of the second fused portion 100, which is exposed in the recessed portion 91 of the metal shell 20, and the intersection of the second fused portion 100 and the second facing portion 102. A distance D5 is the length of the fourth part 104, and a distance D6 is the length of the third part 103. In the spark plug 90, the distance D4 is larger than or equal to the sum of the distance D5 and the distance D6.

With the spark plug 90, because the first fused portion 94 is not formed in the inner peripheral surface 25 of the metal shell 20 and the inner peripheral surface 41 of the cap member 40, it is possible to suppress overheating of the first fused portion 94 and to suppress pre-ignition of a combustible air-fuel mixture that has flowed into the sub-chamber 42. Moreover, because the distance D1 of the first fused portion 94 is larger than or equal to the distance D2 of the first facing portion 96, it is possible to increase the joint strength due to the first fused portion 94.

Because the second fused portion 100 is not formed in the inner peripheral surface 25 of the metal shell 20 and a region of the ground electrode 30 disposed in the sub-chamber 42, it is possible to suppress pre-ignition of the combustible air-fuel mixture, which has flowed into the sub-chamber 42, due to overheating of the second fused portion 100. Moreover, because the second facing portion 102 is bent, it is possible to provide a sufficient distance from the inner peripheral surface 25 of the metal shell 20 to the second fused portion 100. As a result, it is possible to further suppress pre-ignition of the combustible air-fuel mixture in the sub-chamber 42. Furthermore, because the ground electrode 30 is in contact with the metal shell 20 along the entire periphery at the third part 103, it is possible to further reduce the effect of the second fused portion 100 on pre-ignition.

Because the second fused portion 100 is in contact with the fourth part 104, it is possible to increase the joint strength of the ground electrode 30. Moreover, because the distance D4 is larger than or equal to the sum of the distance D5 and the distance D6, it is possible to increase the joint strength of the ground electrode 30.

Figure 5:
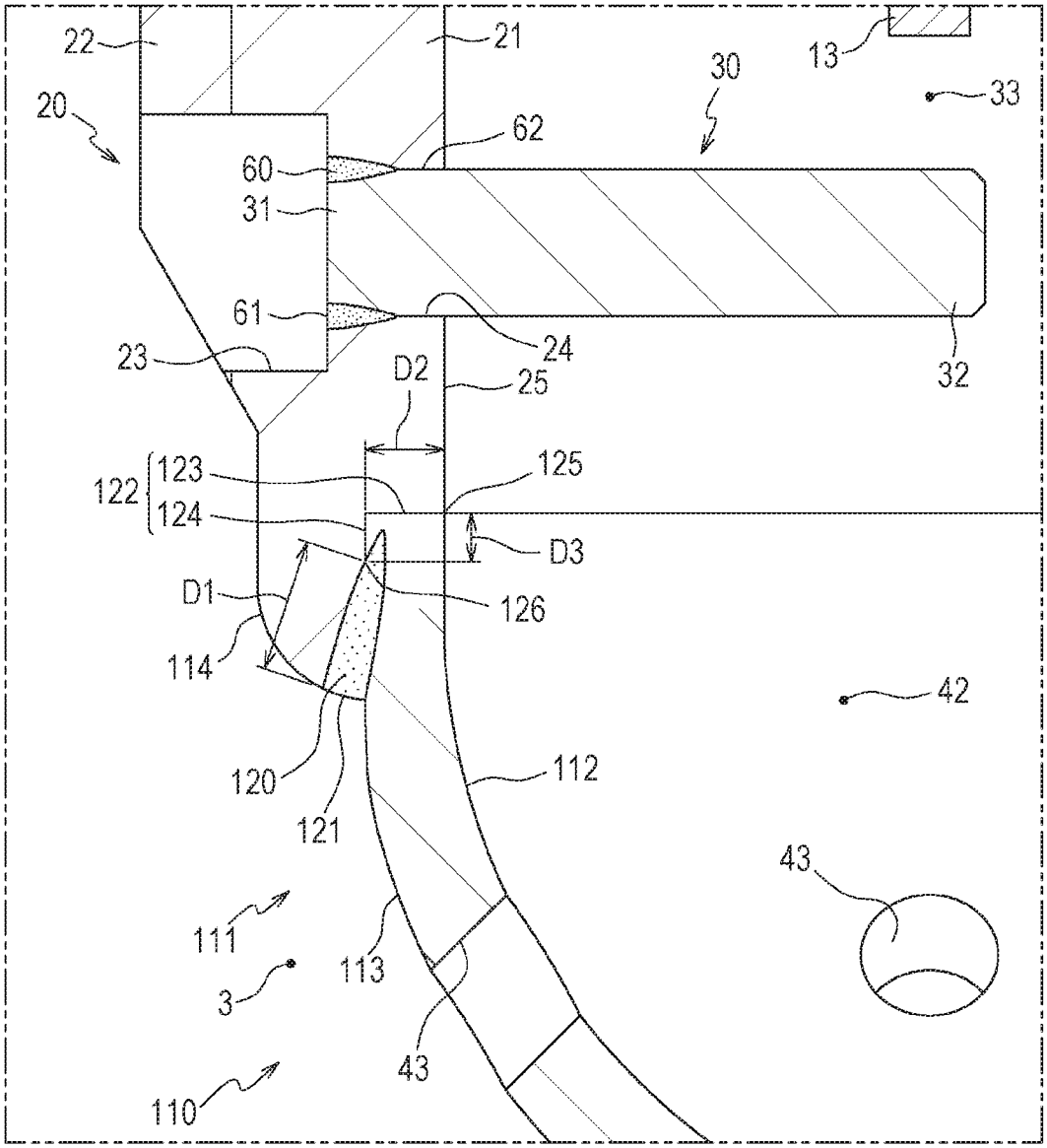
FIG. 5 is a cross-sectional view of a spark plug according to a fourth embodiment.

Referring to FIG. 5, a fourth embodiment will be described. The fourth embodiment is different from the first embodiment in the shape of a portion on the front-end side relative to the spark gap 33, but is the same as the first embodiment in other respects. Therefore, parts of the fourth embodiment that are the same as those described in the first embodiment will be denoted by the same numerals, and description of such parts will be omitted. FIG. 5 is a cross-sectional view of a spark plug 110 according to the fourth embodiment, including the axial line O.

A cap member 111, which forms the sub-chamber 42, has a spherical-cap-shaped inner peripheral surface 112. In order to prevent a step from being easily formed at the boundary between the inner peripheral surface 112 of the cap member 111 and the cylindrical inner peripheral surface 25 of the metal shell 20, the cap member 111 is disposed in such a way that the inner peripheral surface 112 of the cap member 111 conforms to the inner peripheral surface 25 of the metal shell 20. The cap member 111 is joined to the metal shell 20 in such a way that an outer peripheral surface 113 of the cap member 111 is disposed inside in the radial direction relative to an outer peripheral surface 114 of the metal shell 20.

A first fused portion 120, which joins the metal shell 20 and the cap member 111, is located on the front-end side relative to the spark gap 33, and is formed along the entire peripheries of the metal shell 20 and the cap member 111 around the axial line O. The first fused portion 120 is a portion at which the base materials of the metal shell 20 and the cap member 111 are fused together. The thermal conductivity of the first fused portion 120 is lower than the thermal conductivity of the base material of the metal shell 20 and the thermal conductivity of the base material of the cap member 111.

A first facing portion 122, at which the metal shell 20 and the cap member 111 face each other, includes a first part 123 that is located on the innermost side of the cap member 111 in the radial direction and a second part 124 that is connected to the outside of the first part 123 in the radial direction. The second part 124 is bent with respect to the first part 123. The second part 124 is a so-called interference fit. At the second part 124, the cap member 111 is in contact with the metal shell 20 along the entire periphery. The first fused portion 120 is in contact the second part 124.

An end 125 of the first facing portion 122 inside in the radial direction is located on the rear-end side in the axial direction relative to an end 126 of the first facing portion 122 outside in the radial direction. The end 125 of the first facing portion 122 is located on the rear-end side relative to the through holes 43. A part of the first part 123 of the first facing portion 122 (a part of the first part 123 inside in the radial direction) is located on the sub-chamber 42 side relative to the first fused portion 120. The first fused portion 120 is not formed in the inner peripheral surface 25 of the metal shell 20 and the inner peripheral surface 112 of the cap member 111.

A distance D1 (shortest distance) is the length of a line segment that is the shortest among line segments that connect an outer peripheral surface 121 of the first fused portion 120, which is exposed at the outer peripheral surface 114 of the metal shell 20, and the intersection of the first fused portion 120 and the first facing portion 122 (the end 126). A distance that is the sum of a distance D2 and a distance D3 is the shortest distance of the first facing portion 122 along the first facing portion 122. In the spark plug 110, the distance D1 is larger than or equal to the sum of the distance D2 and the distance D3.

With the spark plug 110, because the first fused portion 120 is not formed in the inner peripheral surface 25 of the metal shell 20 and the inner peripheral surface 112 of the cap member 111, it is possible to suppress overheating of the first fused portion 120 and to suppress pre-ignition of a combustible air-fuel mixture that has flowed into the sub-chamber 42. Moreover, because the first facing portion 122 is bent, it is possible to provide a sufficient distance from the inner peripheral surface 25 of the metal shell 20 and the inner peripheral surface 112 of the cap member 111 to the first fused portion 120. As a result, it is possible to further suppress pre-ignition of the combustible air-fuel mixture in the sub-chamber 42. Moreover, because the cap member 111 is in contact with the metal shell 20 along the entire periphery at the second part 124, it is possible to further reduce the effect of the first fused portion 120 on pre-ignition. Furthermore, because the distance D1 of the first fused portion 120 is larger than or equal to the sum of the distance D2 and the distance D3, it is possible to increase the joint strength.

Heretofore, the present invention has been described on the basis of embodiments. However, the present invention is not limited to the embodiments described above, and it can be easily understood that various improvements and modifications can be made within the spirit and scope of the present invention.

In the embodiments, the cap members 40 and 111 having the spherical-cap-shaped inner peripheral surfaces 41 and 112 are joined to the metal shell 20. However, this is not a limitation. The cap member may have any appropriate shape. For example, a cap member having a bottomed-cylindrical shape or a disk-like shape may be used.

In the embodiments, the second parts 54, 78, and 124 of the first facing portions 52, 76, and 122 are each a so-called interference fit. However, this is not a limitation. The second parts 54, 78, and 124 each may be a clearance fit or a transition fit.

In the first embodiment, the distance D1 of the first fused portion 50 is larger than or equal to the distance (D2+D3) of the first facing portion 52. However, this is not a limitation. The distance D1 may be smaller than the distance (D2+D3). Also in this case, it is possible to increase the joint strength, as long as the first fused portion 50 is in contact with the second part 54.

In the second embodiment, the first fused portion 74 and the second part 78 are separated. However, the first fused portion 74 may be in contact with the second part 78 in order to increase the joint strength. Even in the case where the first fused portion 74 and the second part 78 are separated, it is possible to increase the joint strength by making the shortest distance of the first fused portion 74 from an outer peripheral surface 75 of the first fused portion 74 to the first facing portion 76 larger than or equal to the shortest distance of the first facing portion 76 along the first facing portion 76.

In the fourth embodiment, the second part 124 is formed on the rear-end side of the first fused portion 120. However, this is not a limitation. The second part 124 may be omitted by adjusting penetration of the first fused portion 120 and by making the first fused portion 120 be in contact with the first part 123.

In the embodiments, the first parts 53, 77, and 123 of the first facing portions 52, 76, and 122 and the first facing portion 96 are perpendicular to the axial line O. However, this is not a limitation. These may intersect the axial line O. In the embodiments, the second parts 54, 78, and 124 of the first facing portions 52, 76, and 122 each have a cylindrical shape centered on the axial line O. However, this is not a limitation. The second parts 54, 78, and 124 each may have a conical-frustum shape or a spherical shape centered on the axial line O.

In the embodiments, the first parts 53, 77, and 123 and the second parts 54, 78, and 124 are directly connected in the first facing portions 52, 76, and 122. However, this is not a limitation. The first parts 53, 77, and 123 and the second parts 54, 78, and 124 may be connected via a conical-frustum-shaped portion or a spherical-zone-shaped portion. Likewise, in the second facing portions 82 and 102, the third parts 83 and 103 and the fourth parts 84 and 104 may be connected via a conical-frustum-shaped portion or a spherical-zone-shaped portion.

Each embodiment may be modified by adding one part or a plurality of parts of another embodiment to the embodiment or by replacing one part or a plurality of parts of the embodiment with one part or a plurality of parts of another embodiment.

For example, instead of the configuration with which the ground electrode 30 is joined to the metal shell 20 in the first embodiment, the configuration with which the ground electrode 30 is joined to the metal shell 20 in the second embodiment, or the configuration with which the ground electrode 30 is joined to the metal shell 20 in the third embodiment may be used in the first embodiment. Moreover, instead of the configuration with which the cap member 40 is joined to the metal shell 20 in the first embodiment, the configuration with which the cap member 40 is joined to the metal shell 20 in the second embodiment, or the configuration with which the cap member 40 is joined to the metal shell 20 in the third embodiment may be used in the first embodiment.

What is claimed is:

1. A spark plug comprising:

a tubular metal shell that extends from a front-end side toward a rear-end side along an axial line;

a center electrode that is insulated and held on an inner peripheral side of the metal shell;

a ground electrode that has one end portion joined to the metal shell and the other end portion forming a spark gap between the other end portion and a front end portion of the center electrode, the ground electrode formed as a bar-shaped member; and a cap member that is joined to a front end portion of the metal shell, that covers the front end portion of the center electrode and the other end portion of the ground electrode and forms a sub-chamber, and in which a through hole that connects the sub-chamber and a combustion chamber is formed, wherein a first fused portion that joins the metal shell and the cap member is located on the front-end side relative to the spark gap, wherein the spark plug includes a first facing portion at which the metal shell and the cap member face each other, wherein at least a part of the first facing portion is located on the sub-chamber side relative to the first fused portion, and wherein the first fused portion does not extend to an inner peripheral surface of the metal shell and an inner peripheral surface of the cap member.

2. The spark plug according to claim 1, wherein the first facing portion is bent.

3. The spark plug according to claim 2, wherein the inner peripheral surface of the cap member conforms to the inner peripheral surface of the metal shell, and wherein an end of the first facing portion inside in a radial direction is located on the rear-end side in an axial direction relative to an end of the first facing portion outside in the radial direction.

4. The spark plug according to claim 2, wherein the first facing portion includes a first part that is located on an innermost side in the radial direction and a second part that is connected to an outside of the first part in the radial direction and at which the metal shell and the cap member face each other in a direction different from a direction in which the metal shell and the cap member face each other at the first part, and wherein, at the second part, the cap member is in contact with the metal shell along an entire periphery.

5. The spark plug according to claim 2, wherein the first fused portion is in contact with the second part.

6. The spark plug according to claim 1, wherein, in a cross section including the axial line, a shortest distance of the first fused portion from an outer peripheral surface of the first fused portion, the outer peripheral surface being exposed at an outer peripheral surface of the cap member, to the first facing portion is larger than or equal to a shortest distance of the first facing portion along the first facing portion.

7. A spark plug comprising:

a tubular metal shell that extends from a front-end side toward a rear-end side along an axial line;

a center electrode that is insulated and held on an inner peripheral side of the metal shell;

a ground electrode that has one end portion joined to the metal shell and the other end portion forming a spark gap between the other end portion and a front end portion of the center electrode, the ground electrode formed as a bar-shaped member; and a cap member that is joined to a front end portion of the metal shell, that covers the front end portion of the center electrode and the other end portion of the ground electrode and forms a sub-chamber, and in which a through hole that connects the sub-chamber and a combustion chamber is formed, wherein the ground electrode is joined to the metal shell via a second fused portion, wherein the spark plug includes a second facing portion at which the metal shell and the ground electrode face each other, wherein at least a part of the second facing portion is located on the sub-chamber side relative to the second fused portion, and wherein the second fused portion is not formed in an inner peripheral surface of the metal shell and a region of the ground electrode disposed in the sub-chamber.

8. The spark plug according to claim 7, wherein the second facing portion is bent.

9. The spark plug according to claim 8, wherein the second facing portion includes a third part that is located on an innermost side in a radial direction and a fourth part that is connected to an outside of the third part in the radial direction and at which the metal shell and the ground electrode face each other in a direction different from a direction in which the metal shell and the ground electrode face each other at the third part, and wherein the second fused portion is in contact with the fourth part.

* * * * *